US008114794B2

(12) United States Patent
Grynaeus et al.

(10) Patent No.: US 8,114,794 B2
(45) Date of Patent: Feb. 14, 2012

(54) ELASTIC, SOFT AND PUNCTIFORMLY BOUND NON-WOVEN FABRIC PROVIDED WITH FILLER PARTICLES AND METHOD FOR PRODUCTION AND THE USE THEREOF

(75) Inventors: Peter Grynaeus, Birkenau (DE); Hans Rettig, Laudenbach (DE); Oliver Staudenmayer, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 771 days.

(21) Appl. No.: 11/994,071

(22) PCT Filed: Apr. 28, 2006

(86) PCT No.: PCT/EP2006/003954

§ 371 (c)(1),
(2), (4) Date: Nov. 4, 2008

(87) PCT Pub. No.: WO2007/000206

PCT Pub. Date: Jan. 4, 2007

(65) Prior Publication Data

US 2009/0100565 A1 Apr. 23, 2009

(30) Foreign Application Priority Data

Jun. 28, 2005 (DE) ..... 10 2005 030 484

(51) Int. Cl.
*B32B 5/16* (2006.01)
*D04H 1/00* (2006.01)
*D04H 3/00* (2006.01)

(52) U.S. Cl. ..... 442/417; 428/364; 428/365; 428/369; 428/370; 442/327; 442/328; 442/329; 442/164; 442/352; 442/353; 442/359; 442/360; 442/361; 442/356; 442/357; 442/415

(58) Field of Classification Search ..... 442/417, 442/356, 357, 164, 327–329, 352, 353, 359–361, 442/415; 428/365, 369, 370, 364
See application file for complete search history.

(56) References Cited

U.S. PATENT DOCUMENTS

| | | | |
|---|---|---|---|
| 3,059,313 | A | 10/1962 | Harmon |
| 3,427,250 | A | 2/1969 | Haas et al. |
| 4,056,478 | A | 11/1977 | Capelli |
| 4,152,784 | A | 5/1979 | McGalliard |
| 4,201,822 | A | 5/1980 | Cowsar |
| 4,446,177 | A | 5/1984 | Munoz et al. |
| 4,464,271 | A | 8/1984 | Munteanu et al. |
| 4,504,402 | A | 3/1985 | Chen et al. |
| 4,524,529 | A | 6/1985 | Schaefer |
| 4,556,439 | A | 12/1985 | Bannink, Jr. |
| 4,600,605 | A | 7/1986 | Nakai et al. |
| 4,618,524 | A | 10/1986 | Groitzsch et al. |
| 4,623,575 | A | 11/1986 | Brooks et al. |
| 4,748,044 | A | 5/1988 | Fottinger et al. |
| RE32,713 | E | 7/1988 | Woo |
| 4,756,958 | A | 7/1988 | Bryant et al. |
| 4,774,133 | A | 9/1988 | Doree et al. |
| 4,820,575 | A | 4/1989 | Koelzer |
| 4,871,615 | A | 10/1989 | Vigo et al. |
| 4,882,220 | A | 11/1989 | Ono et al. |
| 4,917,920 | A | 4/1990 | Ono et al. |
| 4,939,020 | A | 7/1990 | Takashima et al. |
| 5,000,090 | A | 3/1991 | Telc et al. |
| 5,126,061 | A | 6/1992 | Michael |
| 5,156,843 | A | 10/1992 | Leong et al. |
| 5,232,769 | A | 8/1993 | Yamato et al. |
| 5,366,801 | A | 11/1994 | Bryant et al. |
| 5,532,039 | A | 7/1996 | Payne et al. |
| 5,637,389 | A | 6/1997 | Colvin et al. |
| 5,677,049 | A | 10/1997 | Torii |
| 5,722,482 | A | 3/1998 | Buckley |
| 5,851,338 | A | 12/1998 | Pushaw |
| 6,004,662 | A | 12/1999 | Bukley |
| 6,077,597 | A | 6/2000 | Pause |
| 6,197,415 | B1 | 3/2001 | Holman |
| 6,207,738 | B1 | 3/2001 | Zuckerman et al. |
| 6,514,362 | B1 | 2/2003 | Zuckerman et al. |
| 6,517,648 | B1 | 2/2003 | Houchette et al. |
| 6,607,994 | B2 | 8/2003 | Soane et al. |
| 6,613,704 | B1 * | 9/2003 | Arnold et al. ..... 442/361 |
| 6,685,746 | B1 | 2/2004 | Painter |
| 6,981,341 | B2 | 1/2006 | Baychar |
| 7,036,197 | B2 | 5/2006 | Zafiroglu et al. |
| 2002/0034910 | A1 | 3/2002 | Johnson |
| 2005/0227047 | A1 | 10/2005 | Sutter et al. |
| 2007/0212967 | A1 | 9/2007 | Grynaeus et al. |

FOREIGN PATENT DOCUMENTS

CA 1 182 067 2/1985

(Continued)

OTHER PUBLICATIONS

Office Action from related U.S. Appl. No. 11/799,551 dated Dec. 28, 2010.

Final Office Action from related U.S. Appl. No. 11/799,551 dated Jun. 29, 2010.

Office Action from related U.S. Appl. No. 11/799,551 dated Mar. 15, 2010.

International Search Report dated Sep. 8, 2006 issued in related International Patent Application No. PCT/EP2006003954.

Papers from *Outlast* v. *Frisby*, Civil Action No. 01-N-1882 (CBS)(BNB) (District of Colorado), related to certain above-cited US patent documents, including: Order on Cross Motions for Partial Summary Judgment, Filed Jan. 14, 2004; Brief in Support of Defendant's Motion Under Rule 56, FRCP, for Partial Summary Judgment of Non-Infringement and in Opposition to Plaintiff's Motion for a Preliminary Injunction; Frisby's Reply Brief in Support of its Motion for Partial Summary Judgment on Non-Infringement; Declaration of Rory A. Holmes; Deposition of Dr. Peter J. Hauser; Plaintiff's.

(Continued)

*Primary Examiner* — Norca L Torres Velazquez
(74) *Attorney, Agent, or Firm* — Grossman, Tucker, Perreault & Pfleger, PLLC

(57) ABSTRACT

The invention relates to a nonwoven fabric which is bonded at selected points by use of a binder containing particles composed of filler material (a phase change material, among others) and which is not bonded at other selected points. The nonwoven fabric is characterized by a soft touch and good flexibility, and may be used as an interlining material or an intermediate layer.

18 Claims, No Drawings

FOREIGN PATENT DOCUMENTS

| | | |
|---|---|---|
| CA | 1 182 068 | 2/1985 |
| CA | 2137554 | 3/2005 |
| CH | 446259 | 12/1960 |
| DE | 1127320 | 4/1962 |
| DE | 2914617 | 10/1980 |
| DE | 19510793 | 8/1996 |
| DE | 69316027 | 5/1998 |
| EP | 0123794 | 11/1984 |
| EP | 0178372 | 4/1986 |
| EP | 0190788 | 8/1986 |
| EP | 0222399 | 11/1986 |
| EP | 0361338 | 4/1990 |
| EP | 0611330 | 1/1998 |
| GB | 2 073 613 | 10/1981 |
| GB | 2334428 | 8/1999 |
| JP | 57-128248 | 8/1982 |
| JP | 63-35865 | 2/1988 |
| JP | 64-085374 | 3/1989 |
| JP | 3-213556 | 9/1991 |
| JP | 5-156570 | 6/1993 |
| JP | 5156570 | 6/1993 |
| JP | 7-3596 | 1/1995 |
| JP | 7-70902 | 3/1995 |
| JP | 7-70943 | 3/1995 |
| JP | 10-502137 | 2/1998 |
| KR | 10-0820034 | 4/2008 |
| KR | 10-0890322 | 4/2009 |
| WO | 9324241 | 12/1993 |
| WO | 95/34609 | 12/1995 |
| WO | 00/56940 | 9/2000 |
| WO | 01/06054 | 1/2001 |
| WO | 01/92010 | 12/2001 |
| WO | 02/12607 | 2/2002 |
| WO | 0212607 | 2/2002 |
| WO | 02059414 | 8/2002 |
| WO | 02/092911 | 11/2002 |
| WO | 02095314 | 11/2002 |
| WO | 03/056086 | 7/2003 |
| WO | 03/056088 | 7/2003 |
| WO | 03056086 | 7/2003 |
| WO | 2005/005704 | 1/2005 |

OTHER PUBLICATIONS

Abstract of Knitting International, 99(1184), pp. 42-43, 1992.
Smith, Textile World, 145(10), pp. 69+3, 1995.
Abstract of Lennox-Kerr, Technical Textiles International, 7(6), pp. 25+2, 1998.
Office Action from corresponding Canadian Application No. 2,417,876 dated Oct. 10, 2006.
Supplementary European Search Report from corresponding EPO Application No. 01 964 553.0 dated Apr. 10, 2008.
Communication from corresponding EPO Application No. 01 964 553.0 dated Jul. 28, 2008.
English translation of Office Action from corresponding Japanese Application No. 2002-517882 dated Feb. 22, 2011.

* cited by examiner

ELASTIC, SOFT AND PUNCTIFORMLY BOUND NON-WOVEN FABRIC PROVIDED WITH FILLER PARTICLES AND METHOD FOR PRODUCTION AND THE USE THEREOF

FIELD OF THE INVENTION

The present invention relates to a nonwoven fabric which is suited in particular as an interlining material, a method for producing same, and use thereof for production of interlinings.

BACKGROUND

Textile fabrics provided with fillers, in particular fillers having heat-regulating properties, are known.

EP-A-178 372 discloses a drapable microporous multilayer nonwoven fabric for medical applications. The middle layer is composed of microfibers, and is covered on both sides with nonwoven fabrics. The individual layers are joined by use of a binder paste, a paraffin emulsion, for example, imprinted in a pattern.

EP-A-190 788 describes nonwovens which contain microspheres, preferably foamed, which are arranged in patterns and which may be used as reinforcement materials for plastics.

U.S. Pat. No. 5,366,801 or EP-A-611 330 describe the coating of a woven fabric with a binder and microcapsules distributed therein which contain a phase change material.

A nonwoven fabric having temperature-regulating properties is known from WO-A-02/12607. In one embodiment described therein, the nonwoven fabric is impregnated with a binder containing a dispersed microencapsulated phase change material. The material which imparts heat-regulating properties is distributed throughout the interior of the nonwoven fabric. In addition to embodiments in which the entire inner volume is filled with this material, variants are described in which the material is present only at the intersection points of the fibers, and the interstices are filled with air. However, in this cited embodiment the entire nonwoven fabric is impregnated with the material. This is achieved by saturating the provided nonwoven fabric with the binder. Nonwoven fabrics, i.e., mechanically stabilized/bonded materials, are used as starting materials.

WO-A-02/59414 describes a coated material having temperature-regulating properties and improved flexibility and air permeability. The coated material is composed of a substrate which is provided on a portion of its surface with binder dots or with layers of binders containing temperature-regulating materials. The binders may be applied to the surface, or may penetrate into the interior of the substrate and partially or completely permeate same. In any case, a portion of the surface is not impregnated with binder. Various coated substrates such as woven fabrics, nonwoven fabrics, films, foams, and papers are described.

Substrates having improved temperature-regulating properties are also known from WO-A-02/95314. According to the cited document, polymer dispersions containing phase change materials are applied in a napped pattern to a textile surface by screen printing. In addition to metal foils and textile surfaces, nonwoven fabrics, i.e. mechanically stabilized materials/bonded fibrous webs, are mentioned as possible substrates.

The substrates used heretofore in the prior art with regard to textile surfaces are structures which after production are stabilized (bonded, consolidated) to allow ease of handling. Thus, for example, nonwoven fabrics are manufactured by providing a fibrous web with a surface which is still mechanically unstable ("fleece formation"), then performing nonwoven bonding (see, for example, Vliesstoffe [Nonwoven Fabrics], edited by W. Albrecht, H. Fuchs, and W. Kittelmann, Wiley-VCH (2000), Part II, Manufacturing Methods for Nonwoven Fabrics, Chapter 6, Nonwoven Bonding). Typical processes for nonwoven bonding include chemical methods, such as application of a binder, or physical methods (mechanical and/or thermal methods), such as needling, interlacing, treatment with heated air, or calendering. These processes directly follow the nonwoven fabric formation process in order to convert the mechanically very unstable fibrous web to a manipulable form.

In the sense of the present description, "nonwoven fabrics" are understood to mean processed layers, fleeces, or fibrous webs composed of directionally or randomly oriented fibers which are bonded by friction and/or cohesion and/or adhesion (as defined in ISO 9092 or EN 29 092).

Attempts have also been made to apply the binder by screen printing directly after formation of the nonwoven fabric by applying paste-like binder liquids to the still unstable fibrous web, using a rotary screen printing machine (see, for example, Vliesstoffe, edited by W. Albrecht, H. Fuchs, and W. Kittelmann, Wiley-VCH (2000), Chapter 6.5, Chemical Methods, page 381). These methods have thus far not become established in the art due to the technical problem of uniformly binding a fibrous web using "adhesive" binders. The loose fibers of the fibrous web tend to adhere to the printing screen, and after a short time impede the printing process. This phenomenon may be counteracted by subjecting the fibrous web to intense compression or pressure (over the entire surface or at selected points), but the resulting products are therefore very flat and have less of a textile quality; in addition, the binder bleeds through heavily.

DE-A-29 14 617 describes a method for uniform, continuous imprinting of pastes onto the front and back sides of textile fabrics. According to the example, a fibrous web produced by carding is led through a calender and prebonded. A binder dispersion is then applied in a pattern to both sides of this textile fabric, using rollers, and drying is then performed to crosslink the binder.

Heretofore, nonwoven fabrics having heat-regulating properties have been produced by aftertreatment of nonwoven fabrics, i.e., bonded, mechanically stabilized textile surfaces, with heat-regulating materials. As a result of the prior bonding step, in many cases the elasticity and softness of these nonwoven fabrics leave much to be desired.

DESCRIPTION OF THE INVENTION

On the basis of the above-described prior art, the object of the present invention is to provide a nonwoven fabric which contains filler material, and which has high elasticity as well as a high degree of softness. It is thus possible to produce textiles having improved fit and wear comfort.

A further object of the present invention is to provide an improved manufacturing method for nonwoven fabrics containing filler materials, wherein the prior step of nonwoven fabric bonding may be omitted, thereby allowing nonwoven fabrics to be produced with less expenditure of effort.

The present invention relates to a nonwoven fabric having crimped and uncrimped fibers and/or filaments and which is bonded at selected points using a binder containing particles composed of filler material and which is not bonded at other selected points.

As the result of applying and optionally curing the binder containing filler material directly on the unbonded fleece, i.e., on the fibrous web directly after placement on a backing, a fabric is produced which is not bonded in selected surface regions, i.e., has not been subjected to fleece formation in these surface regions. The permeability, elasticity, and hand of the nonwoven fabric are improved by the presence of nonbonded regions.

In the present invention, heat-crimpable fibers or filaments are used in the production of the fibrous web. The fibrous web also preferably contains fibers or filaments which are uncrimped and noncrimpable, or which under the processing conditions are noncrimpable.

Thus, the nonwoven fabric according to the invention contains crimped fibers and/or filaments, and preferably also contains uncrimped fibers and/or filaments.

Within the scope of the present description, "fibers" are understood to mean threads of finite length (staple fibers), i.e., threads having lengths down to the decimeter range.

Within the scope of the present description, "filaments" are understood to mean threads of essentially continuous length, i.e., threads having lengths above the decimeter range.

Bicomponent fibers or filaments may be used as heat-crimpable fibers or filaments to avoid the problems of the products currently known from the prior art.

Bicomponent fibers or filaments have been used for quite some time in the manufacture of nonwoven fabrics. In the form of core-sheath fibers or filaments containing low-melting sheath components they may be used as binder fibers in the thermal bonding of nonwoven fabrics (over the entire surface or at selected points) (see, for example, Vliesstoffe, edited by W. Albrecht, H. Fuchs, and W. Kittelmann, Wiley-VCH (2000), Chapter 1.2, Chemical Fibers—Bicomponent Fibers, page 63).

The bicomponent fibers or filaments are not used in the nonwoven fabric according to the invention because of the adhering/binding properties of low-melting components. Bicomponent fibers or filaments composed of polymer components having similar melting points may be used; these are structured, for example, in a side-by-side arrangement or in an asymmetrical core-sheath arrangement in such a way that during heat treatment a different shrinkage is induced along the fiber or filament axis. Instead of or in addition to the bicomponent fibers or filaments, homopolymer fibers or filaments may be used which during production have been subjected to asymmetrical cooling of the fiber/filament over their cross section.

During manufacture of the nonwoven fabric, the portion of these crimpable fibers or filaments used causes an in situ contraction of the fibrous web when acted on by heat prior to the printing unit. The crimping fibers or filaments result in an improvement of the interior composition of the fibrous web, thereby greatly facilitating printing of the nonwoven fabric. The nonwoven fabric also acquires volume and elasticity. The temperature profile for the heat treatment is selected such that the treatment temperature is below the melting or softening temperature of the lower-melting or softening polymer of the multicomponent fibers, so that the heat treatment induces crimping but not adhesion.

As the result of inducing crimping during manufacture of the nonwoven fabric according to the invention, the imprinted binder dots also acquire volume and softness, since the crimping fibers or filaments do not form compact points in the fiber matrix. The binder dots may be foamed, although this is not necessary.

To achieve a particularly soft and elastic product, nonwoven fabrics containing two- or three-dimensionally crimped fibers and/or filaments are preferred.

The fibrous webs used according to the invention may be composed of any given fiber types of various titer ranges, for example a titer of 0.5 to 10 dtex, preferably 0.8 to 6.7 dtex, in particular 1.3 to 3.3 dtex. The fiber mixture should contain at least 5% by weight, preferably at least 20% by weight, of crimping fibers or filaments. These may be heterofil fibers/bicomponent fibers or specialized homofil fibers (or the corresponding filaments). The remaining fibers may be staple fibers or filaments commonly used in nonwoven fabric manufacture.

The fibrous webs used according to the invention may be produced using various fleece formation techniques. These primarily involve carded, dry-laid fibrous webs. Direct fiber-laying techniques using the spunbonded nonwoven fabric process or melt-blown process are also possible.

Fibrous webs composed of staple fibers are particularly preferably used.

The fibers of the fibrous webs used may be laid isotropically or in a preferred direction, i.e., anisotropically. The fibrous web may be composed of the same or different titers of the same fiber. The fibers forming the fibrous web may be composed of various types of fibers, for example homofil fibers, or also from 100% bicomponent fibers or a blend of bicomponent fibers and homofil fibers. Mixtures of synthetic fibers and natural fibers may also be used.

Polyester homofil fibers, for example 1.7 dtex/38 mm or 3.3 dtex/51 mm homopolyester fiber in a mixture with polyester bicomponent fibers such as polyester side-by-side bicomponent fibers, are preferably used. Polyamide fibers composed of 3d/1.5" PA 66, for example, may also be used in the mixture. A proportion of at least 5%, preferably at least 20%, heterofil fibers, preferably bico fibers, is necessary.

The fibrous webs used according to the invention may be shrunk by up to 50% under the manufacturing conditions for the nonwoven fabric, depending on the quantity of heterofil fiber added. However, in the subsequent work steps the nonwoven fabric is stabilized, preferably with low shrinkage, for example −3.0% in the machine direction and −1.5% in the transverse direction.

The fibrous webs used typically have a mass per unit area of 15 to 210 $g/m^2$.

Carded fibrous webs having a mass per unit area of 35 to 140 $g/m^2$ are particularly preferably used.

Examples of fiber materials include polyolefins, preferably polypropylene or polypropylene-ethylene copolymers, polyesters, polyamides, or polyacrylonitrile, in addition to natural fibers, in particular cellulose fibers, cotton fibers, or mixtures thereof.

The binder containing finely dispersed filler material may be of any given type, provided that it is capable of bonding the fibrous web in selected surface regions.

Examples of binders include chemically crosslinking plastics, in particular in the form of dispersions, for example a mixture of ethyl and butyl acrylates with the customary crosslinker groups. However, thermoplastic polymers containing finely dispersed filler material may also be used. These materials act as hot-melt adhesives, and thus result in bonding of the fibers in the treated regions of the fibrous web. Examples of this type of thermoplastic polymer binder include polyolefin powders, in particular polyethylene or polypropylene powders, preferably copolyester powders having a melting range>150° C. Further examples of binders are found in U.S. Pat. No. 5,366,801, WO-A-02/12607, WO-A-02/59414, and WO-A-02/95314.

Any given fine-particle material which is designed to impart a desired property when added to the nonwoven fabric may be used as filler material.

Examples of filler materials include particles having absorbent or adsorbent properties, ion exchangers, mineral fillers, reinforcement materials, electrically and/or thermally conductive materials/particles, and in particular phase change materials.

Expanding microcapsules, activated carbon particles, metal particles, particles composed of superabsorbent materials, or short fibers are particularly preferably used.

Substances known as such may particularly preferably be used as phase change materials. Examples of such are contained in the documents cited above.

Microencapsulated hydrocarbons, in particular microencapsulated paraffins, are very particularly preferably used as phase change materials.

Examples of phase change materials are listed in the following table.

| Compound | Number of carbon atoms | Melting point (° C.) |
|---|---|---|
| n-Decane | 10 | −32 |
| n-Undecane | 11 | −26 |
| n-Dodecane | 12 | −11 |
| n-Tridecane | 13 | −5.5 |
| n-Tetradecane | 14 | 5.9 |
| n-Pentadecane | 15 | 10.0 |
| n-Hexadecane | 16 | 18.2 |
| n-Heptadecane | 17 | 22.0 |
| n-Octadecane | 18 | 28.2 |
| n-Nonadecane | 19 | 32.1 |
| n-Eicosane | 20 | 36.8 |
| n-Heneicosane | 21 | 40.5 |
| n-Docosane | 22 | 44.4 |
| n-Tricosane | 23 | 47.6 |
| n-Tetracosane | 24 | 50.9 |
| n-Pentacosane | 25 | 53.7 |
| n-Hexacosane | 265 [sic; 26] | 56.4 |
| n-Heptacosane | 27 | 59.0 |
| n-Octacosane | 28 | 61.4 |
| n-Nonacosane | 29 | 63.4 |
| n-Triacontane | 30 | 65.4 |
| n-Hentriacontane | 31 | 68.0 |
| n-Dotriacontane | 32 | 70.0 |
| n-Tritriacontane | 33 | 71.0 |
| n-Tetratriacontane | 34 | 72.9 |
| n-Hexatriacontane | 36 | 76.1 |

The weight ratio of fiber material to binder and filler material in the nonwoven fabrics according to the invention is typically 90:10 to 10:90, preferably 50:50 to 30:70.

The binder and filler material are applied to loose fibrous web in predetermined regions using a printing technique, preferably screen printing. The majority of the applied material should penetrate the fibrous web and permeate same to the greatest extent possible. Some of the binder remains on the surface. However, as the result of applying the mixture of binder/filler material at selected points, regions of the fibrous web in which no binder/filler material is present remain in the finished product.

The coverage of the surface with binder/filler material may encompass a broad range, typically greater than 20% and up to 95% of the surface. More than 35% and up to 80% of the surface of the fibrous web is preferably covered with binder/filler material.

The binder/filler material may be applied to the fibrous web in various predetermined patterns. These patterns may be formed from linear, hexagonal, circular, or punctiform surface regions. Dot patterns such as regular or irregular dot patterns are preferred.

The invention further relates to a method for manufacturing the nonwoven fabric according to claim 1, comprising the following measures:

a) Producing a fibrous web by laying heat-crimpable fibers and/or heat-crimpable filaments and optionally non-heat-crimpable fibers and/or non-heat-crimpable filaments in a manner known as such on a laying machine, b) Optionally prebonding the fibrous web using heated rollers, the temperature of which is selected such that crimping of the crimpable fibers and/or filaments is induced, c) Applying binder containing particles composed of filler material to selected locations on the fibrous web in a manner known as such, and d) Heating the fibrous web treated in step c) to completely induce crimping of the crimpable fibers and/or filaments and to join fibers of the fibrous web by means of the binder, and optionally crosslinking the binder.

The fibrous web may be produced as described above, using various methods.

The binder/filler material may likewise be applied to the surface of the fibrous web using any given method. Screen printing methods, in particular using rotary screen printing machines, are preferred.

Therefore, a method is preferred in which the binder is applied using a rotary screen printing machine, which immediately after production of the nonbonded fibrous web and optionally after prebonding of same acts on the surface thereof.

After the binder/filler material is applied, the fibrous web treated in this manner is stabilized by heating. This may be achieved in a manner known as such.

The treated fibrous web is preferably heated by hot rolling, thereby inducing crimping of the fibrous web.

In one preferred embodiment, step a) is carried out by carding and laying fibers on a backing tape.

In a further preferred embodiment, step b) is carried out by passing the fibrous web between heated rollers with little or no pressure so that the treatment does not influence the thickness of the fibrous web, and the temperature of the rollers is selected to be below the melting temperature of the lowest-melting polymer component of the fiber-forming material.

In a further preferred embodiment, step c) is carried out by applying binder containing particles composed of filler material, preferably phase change material, in a punctiform manner, using a template at selected points on the surface of the fibrous web.

The nonwoven fabric according to the invention may be used for many different purposes, for example as interlining material or as an intermediate layer. Examples of uses include clothing, bedding, gloves, or shoes. The nonwoven fabric is used in particular as an interlining material.

These uses likewise constitute subject matter of the present invention.

The following examples explain the invention without limiting the invention thereto.

Example

A fibrous web composed of a mixture of 40% 3.0 dtex/60 mm polyester side-by-side bicomponent fibers, 30% 3.3 dtex/60 mm polyester homofil fibers, and 30% 1.7 dtex/38 mm polyester homofil fibers was produced on a carding machine. This fibrous web had a mass per unit area of 50 g/m$^2$. The carded fibrous web was passed between two hot rollers at 125° C., with no pressure. A 40% mixture composed of a soft acrylate binder and mPCM phase change material in a 1:2 ratio was applied to the fibrous web in a dot pattern, using a rotary screen printing machine. The application rate was 90 g/m$^2$. 82.5% of the surface was imprinted. After the application, the imprinted fibrous web was dried in a multiband dryer at 150° C. and the binder was crosslinked. The product is referred to below as "40% bico, punctiform."

The following tables show the elastic properties of the manufactured nonwoven fabrics as a function of the quantity and type of crimpable bicomponent fibers used.

In the tables, "CTV, full-surface" means a fibrous web that is impregnated over its entire surface with binder/mPCM.

"100% bico, punctiform" refers to a nonwoven fabric according to the invention which has been manufactured analogously to the above-described "40% bico, punctiform," except that 100% bicomponent fibers were used.

"MTF" means maximum tensile force, and "EAB" means elongation at break. The modulus values were measured for various elongation values. The measurements were carried out according to EN 29073-3.

The lower the modulus at low elongation, the more easily the material is stretched.

Tables

| | Weight (g/m$^2$) | MTF, longitud. (N/5 cm) | EAB, longitud. (%) | 5% modulus longitud. (N/5 cm) | 10% modulus longitud. (N/5 cm) | 15% modulus longitud. (N/5 cm) | 25% modulus longitud. (N/5 cm) |
|---|---|---|---|---|---|---|---|
| CTV, full-surface | 140 | 54 | 34 | 17.4 | 28.2 | 36.4 | 49.4 |
| 100% bico, punctiform | 130 | 14 | 58 | 2.2 | 5.6 | 8.5 | 11.9 |
| 40% bico, punctiform | 140 | 13 | 48 | 3.0 | 5.9 | 8.4 | 10.8 |

| | Weight (g/m$^2$) | MTF, transv. (N/5 cm) | EAB, transv. (%) | 5% modulus transv. (N/5 cm) | 10% modulus transv. (N/5 cm) | 15% modulus transv. (N/5 cm) | 25% modulus transv. (N/5 cm) |
|---|---|---|---|---|---|---|---|
| CTV, full-surface | 140 | 55 | 75 | 4.1 | 8.5 | 12 | 18.1 |
| 100% bico, punctiform | 130 | 38 | 76 | 0.3 | 1.1 | 2.7 | 8.1 |
| 40% bico, punctiform | 140 | 31 | 69 | 0.6 | 2.1 | 4.2 | 9.7 |

What is claimed is:

1. Elastic nonwoven fabric containing crimped fibers and/or crimped filaments including bicomponent fibers or filaments and homopolymer fibers or filaments and optionally uncrimped fibers and/or optionally uncrimped filaments, and wherein said bicomponent fibers or filaments are comprised of polymer components having similar melting points which bicomponent fibers do not provide bonding which is bonded at selected points by use of a binder containing particles composed of filler material, and which is not bonded at other selected points, wherein the weight ratio of the fibers or filaments to the binder and filler material is 50:50 to 30:70.

2. Nonwoven fabric according to claim 1, characterized in that said nonwoven fabric contains crimped fibers and/or filaments as well as uncrimped fibers and/or filaments.

3. Nonwoven fabric according to claim 1, characterized in that said nonwoven fabric contains 20% by weight crimped fibers and/or crimped filaments.

4. Nonwoven fabric according to claim 1, characterized in that said nonwoven fabric is a crimped staple fiber nonwoven fabric.

5. Nonwoven fabric according to claim 1, characterized in that said nonwoven fabric contains, in addition to crimped polyester bicomponent fibers, uncrimped polyester homofil fibers and optionally uncrimped polyamide fibers.

6. Nonwoven fabric according to claim 1, characterized in that said nonwoven fabric contains two- or three-dimensionally crimped fibers.

7. Nonwoven fabric according to claim 1, characterized in that the binder contains a chemically crosslinking plastic.

8. Nonwoven fabric according to claim 1, characterized in that the binder contains a thermoplastic polymer which joins the fibers of the fibrous web by means of hot-melt adhesion.

9. Nonwoven fabric according to claim 1, characterized in that particles having absorbent or adsorbent properties, ion exchangers, mineral fillers, reinforcement materials, electrically and/or thermally conductive materials/particles, and phase change materials are used as filler material.

10. Nonwoven fabric according to claim 9, characterized in that expanding microcapsules, activated carbon particles, metal particles, particles composed of superabsorbent materials, or short fibers are used as filler material.

11. Nonwoven fabric according to claim 9, characterized in that the phase change material is a microencapsulated hydrocarbon.

12. Nonwoven fabric according to claim 1, characterized in that the filler containing binder is applied in the form of a regular or irregular dot pattern which permeates the fibrous web.

13. Method for manufacturing the nonwoven fabric according to claim 1, comprising the following measures:

a) producing a fibrous web by laying heat-crimpable fibers and/or heat-crimpable filaments including bicomponent fibers or filaments and homopolymer fibers or filaments and wherein said bicomponent fibers or filaments are comprised of polymer components and optionally non-heat-crimpable fibers and/or non-heat-crimpable filaments in a manner known as such on a laying machine, b) optionally prebonding the fibrous web using heated rollers, the temperature of which is selected such that crimping of the crimpable fibers and/or filaments is induced, c) applying binder containing particles composed of filler material to selected locations on the fibrous web, wherein the weight ratio of the fibers or filaments to the binder and filler material is 50:50 to 30:70, and d) heating the fibrous web treated in step c) to completely induce crimping of the crimpable fibers and/or filaments and to join fibers of the fibrous web by means of the binder, and optionally crosslinking the binder and wherein said heating of said bicomponent fibers does not provide adhesion.

14. Method according to claim 13, characterized in that step a) is carried out by carding and laying fibers on a backing tape.

15. Method according to claim 13, characterized in that step b) is carried out by passing the fibrous web between heated rollers with little or no pressure so that the treatment does not influence the thickness of the fibrous web, and the temperature of the rollers is selected to be below the melting temperature of the lowest-melting polymer component of the fibrous web.

16. Method according to claim 13, characterized in that step c) is carried out by applying binder containing particles composed of filler material in a punctiform manner, using a template at selected points on the fibrous web.

17. Method according to claim 16, characterized in that the binder is applied using a rotary screen printing machine, which immediately after production of the nonbonded fibrous web and optionally after prebonding of same acts on the surface thereof.

18. Use of the nonwoven fabric according to claim 1 as interlining material or as an intermediate layer, in one or more of the following clothing, bedding, gloves, or shoes.

* * * * *